US005749406A

United States Patent [19]

Benthin

[11] Patent Number: 5,749,406

[45] Date of Patent: May 12, 1998

[54] VERTICAL BLIND WITH A CRANK ROD FOR OPERATION

[75] Inventor: Siegfried Benthin, Bremerhaven, Germany

[73] Assignee: Benthin Aktiengesellschaft, Bremerhaven, Germany

[21] Appl. No.: 672,555

[22] Filed: Jun. 28, 1996

[30] Foreign Application Priority Data

Jul. 11, 1995 [DE] Germany ..... 195 25 139.3

[51] Int. Cl.[6] ..... E06B 9/36

[52] U.S. Cl. ..... 160/176.1 V; 160/177 V

[58] Field of Search ..... 160/176.1 V, 174 V, 160/177 V, 168.1 V, 173 V, 178.1 V

[56] References Cited

U.S. PATENT DOCUMENTS

| | | | |
|---|---|---|---|
| 4,214,622 | 7/1980 | Debs . | |
| 4,257,470 | 3/1981 | Woodle | 160/176.1 V X |
| 4,291,738 | 9/1981 | Grenga et al. . | |
| 5,038,843 | 8/1991 | Sommerfeld | 160/176.1 V |
| 5,092,387 | 3/1992 | King et al. | 160/178.1 R X |
| 5,186,229 | 2/1993 | Hsu | 160/178.1 R X |

OTHER PUBLICATIONS

LouverDrape® 800–523–9882, Date Apr. 19, 1995, Title, Zirlon Wheeled System, Textbook in Beispiel, Translation yes.

*Primary Examiner*—Blair Johnson
*Attorney, Agent, or Firm*—McGlew and Tuttle

[57] ABSTRACT

A vertical blind device with a crank rod for operation, in which slats, which are hung on slat carriages, can be pivoted about a vertical axis by 180° from a closed hanging position, directed horizontally in a plane parallel to one another, into the other closed hanging position and are horizontally movable with the slat carriages in a support rail. A pivot pin of a pivot drive is provided for a pivot shaft, guided through all the slat carriages in an axially displaceable manner and adapted to rotate in unison, and the crank rod have complementary coupling elements. The pivot pin lies with its coupling element in the two stopped positions of the slats laterally outside the plane of the closed hanging. During a reversed rotation, the pivot pin with its coupling element, together with the 180° pivoting movement of the slats, pivots from one side to the other side of the then closed hanging slats.

14 Claims, 7 Drawing Sheets

VERTICAL BLIND WITH A CRANK ROD FOR OPERATION

FIELD OF THE INVENTION

The present invention pertains to a vertical blind with a crank rod for operation with slats jointly pivotable about their vertical axis by 180° from a stopped closed hanging position, with the slats directed horizontally in a closed hanging plane parallel to one another, into another stopped closed hanging position with a pivot drive with a pivot pin, the pivot drive and the crank rod having coupling portions for positioning the pivot pin with a coupling element portion, in one stopped position of the slats, laterally outside the closed hanging plane, and pivoting the pivot pin with the coupling element, during a reversed rotation of the pivot pin, together with the 180° pivoting movement of the slats, from one side to the other of the closed hanging plane.

BACKGROUND OF THE INVENTION

In such vertical blinds, the crank rod is coupled with a toothed wheel of a pivot drive, which toothed wheel is arranged in one of the two end carriages of the slat carriages which are connected with one another under one another by means of spacers. The toothed wheel of prior-art arrangements sits on a pivot pin with an eyelet on the lower end, into which eyelet a hook on the upper end of the crank rod is able to be hooked, such that the crank rod is connected with the pivot pin in a movable manner, on the one hand, but in a manner adapted to rotate in unison, on the other hand. The crank rod is used both for pivoting the slats by means of rotation, and for opening and closing the blinds by means of pulling or pushing the end carriage. In prior-art embodiments, for example, according to the prospectus on the "Zirlon Wheeled System" of the firm of Louver Drape, a driving wheel of the pivot drive, which is able to be coupled with the crank rod, is arranged laterally outside the closed hanging of the blind, if the slats are aligned approximately parallel to one another in a common plane. The crank rod hangs freely next to the closed hanging slats of the blind, and it may also be grasped from both sides of the blind (on the outside and on the inside); however, the installation width of the blind is not remarkably increased thereby. Above all, however, a gap of light, which the closed blind is not able to cover, remains next to the end slat. However, also known are vertical blinds that are operated by means of a crank rod, which is moved forward far enough on the front side, so that this crank rod is located in the area of the end slat, but does not hinder this end slat during the pivoting about its own vertical axis. This means for attaining the object is not only difficult and complicated, but also does not resolve the requirement of alternately operating the closed blind from one of the two sides.

A vertical blind, in which a coupling element is rigidly connected with an upper holder of the slat on one of the jointly pivotable slats, especially on an outer slat, has become known from U.S. Pat. No. 4,291,738. The crank rod can be hung in the coupling element of the holder with a corresponding coupling element. Thus, the crank rod acts directly on the slat. A greater expenditure of force is hereby necessary for pivoting the slats especially in large vertical blinds comprising a plurality of slats.

SUMMARY AND OBJECTS OF THE INVENTION

The primary object of the present invention is to design a vertical blind that is operated by means of a crank rod, such that the vertical blind can be operated with little expenditure of force, i.e., the slats are pivotable with little expenditure of force.

According to the invention, a vertical blind device is provided including a crank rod for operation of the device and slats jointly pivotable about their vertical axis by 180° from a stopped closed hanging position, directed horizontally in a plane parallel to one another, into another stopped closed hanging position. A pivot drive is provided with a pivot shaft, a rotatable element and a pivot pin. The pivot drive and the crank rod form complementary coupling element means with coupling portions for positioning the pivot pin with a coupling element portion, in one stopped position of the slats, laterally outside the closed hanging plane, and pivoting the pivot pin with the coupling element, during a reversed rotation of the pivot pin, together with the 180° pivoting movement of the slats, from one side to the other of the closed hanging plane. The pivot pin is mounted in a cardanically movable manner and is connected with the rotatable element of the pivot drive eccentrically to an axis of rotation of the rotatable element. The rotatable element is driven substantially synchronously with the pivot shaft.

By means of the cardanic mounting of the pivot pin and by the eccentric connection of same with the rotatable element, a tilting movement of the pivot pin against the vertical lines is achieved at the same time during the rotation of this element. Depending on the selection of the lever arms, the rotation movement of the crank rod and thus of the element is suitably transmitted to a pivoting movement of the slats. The expenditure of force necessary for pivoting the slats can hereby be maintained within suitable limits, so that even children or elderly people are easily able to operate the vertical blind.

According to the design or embodiment of this means for attaining the object of the present invention, the pivot pin with a spherical joint designed on its free end is mounted in the toothed element of the pivot drive eccentrically to its axis of rotation.

The same result can also be achieved, e.g., by means of a pivot drive with a worm wheel, which can be rotated by the pivot pin, and a toothed wheel, which is arranged on the pivot shaft in an axially displaceable manner and adapted to rotate in unison and which can be driven by the worm wheel, wherein the toothed wheel on the pivot shaft is additionally provided with a worm toothing, which meshes with the toothing of the rotatable element, which has an eccentric joint connection with the pivot pin. An additional reduction in force is possible by selecting suitable transmission ratios of the toothed wheels meshing with one another.

According other aspects of the invention, a vertical blind device is provided including a crank rod for operation of the device and slats jointly pivotable about their vertical axis by 180° from a stopped closed hanging position, with the slats directed horizontally in a closed hanging plane parallel to one another, into another stopped closed hanging position. A pivot drive is provided with a pivot shaft with a worm wheel mounted on the pivot shaft in an axially displaceable manner and adapted to rotate in unison with the pivot shaft, a rotatable element, a spindle worm, a slide part with a female thread and with a rocker arm, and a pivot pin. The pivot pin has a longitudinal axis sloped at an angel with respect to a vertical direction. The pivot pin the pivot drive form complementary coupling element means with coupling portions for positioning the pivot pin with a coupling element portion, in one stopped position of the slats, laterally outside the closed hanging plane, and pivoting the pivot pin with the coupling element, during a reversed rotation of the pivot pin, together with the 180° pivoting movement of the slats, from one side to the other of the closed hanging plane. The pivot pin is mounted in the housing and has a worm toothing, which meshes with a toothing of a the worm wheel. The spindle worm is provided on the pivot shaft meshing with the female thread of the slide part, the pivot pin has an upper end engaging the slide part which guides the pivoting movement of the pivot pin.

In this means for attaining the object as well, a rotation of the crank rod brings about not only a pivoting movement of the slats, but also a tilting movement of the pivot pin. A reduction in the force necessary for pivoting the slats is obtained by selecting a suitable slope of the spindle worm.

According to both suggestions for the means for attaining the object, the slats of the vertical blinds are preferably hung on slat carriages, which can be moved horizontally in a support rail. Thus, the vertical blind can be opened completely like a curtain.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
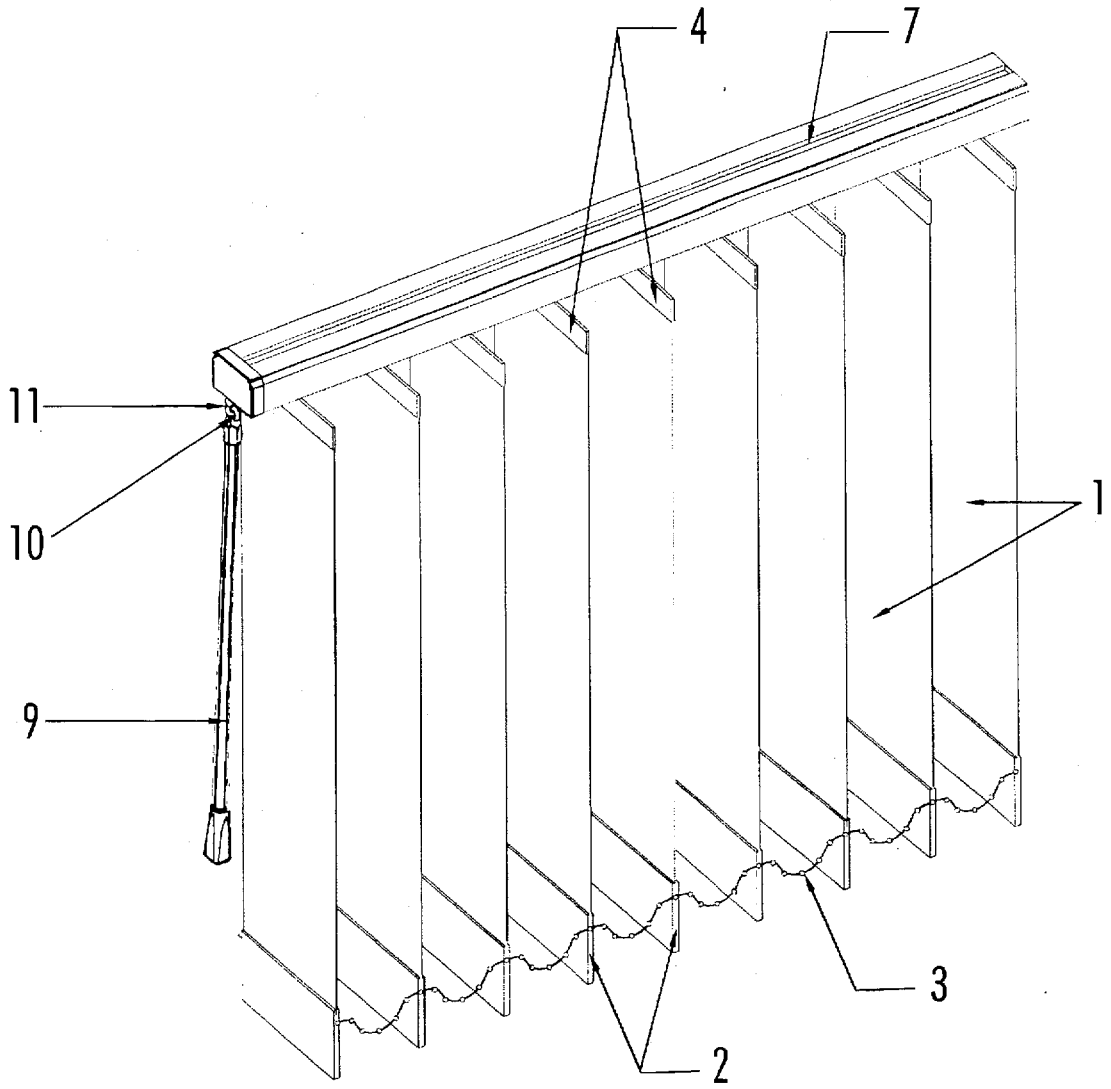
FIG. 1 is a perspective schematic view of a partly open vertical blind.

Referring to the drawings in particular, the invention comprises a vertical blind device with slats 1, consisting, e.g., of strips of a suitable plastic or textile. The slats 1 are weighted by means of weights 2 on their lower end and are connected with one another by means of small chains 3. The slats are attached by slat holders 4, which are arranged on the upper end of the slats and which have an eyelet in the center for hanging a support pin 5 in a hook-like formation. The support pin 5 is pivotable in a slat carriage 6 about the vertical axis of the slat. The slat holders 4 can be moved back and forth in a support rail 7, which extends approximately horizontally and can be attached to a wall, a ceiling or the like. The slats 1 are pivoted about the vertical axis of the support pin 5 by means of a pivot shaft 8. Pivot shaft 8 is mounted in the support rail 7. The pivot shaft 8 meshes axially displaceably with a toothed wheel of a bevel gear in all slat carriages 6. The pivot shaft 8 is rigidly coupled with the toothed wheel in the direction of rotation. All the slat carriages 6 are connected with one another in the longitudinal direction of the support rail 7 by means of spacers, which are not shown in the drawing.

The slats 1 of the blind device are moved by means of a crank rod 9, which can be hung with a hook 10 on its upper end in an eyelet 11 on the lower end of a pivot pin 12 in a movable manner, on the one hand, but adapted to rotate in unison, on the other hand.

Figure 2:
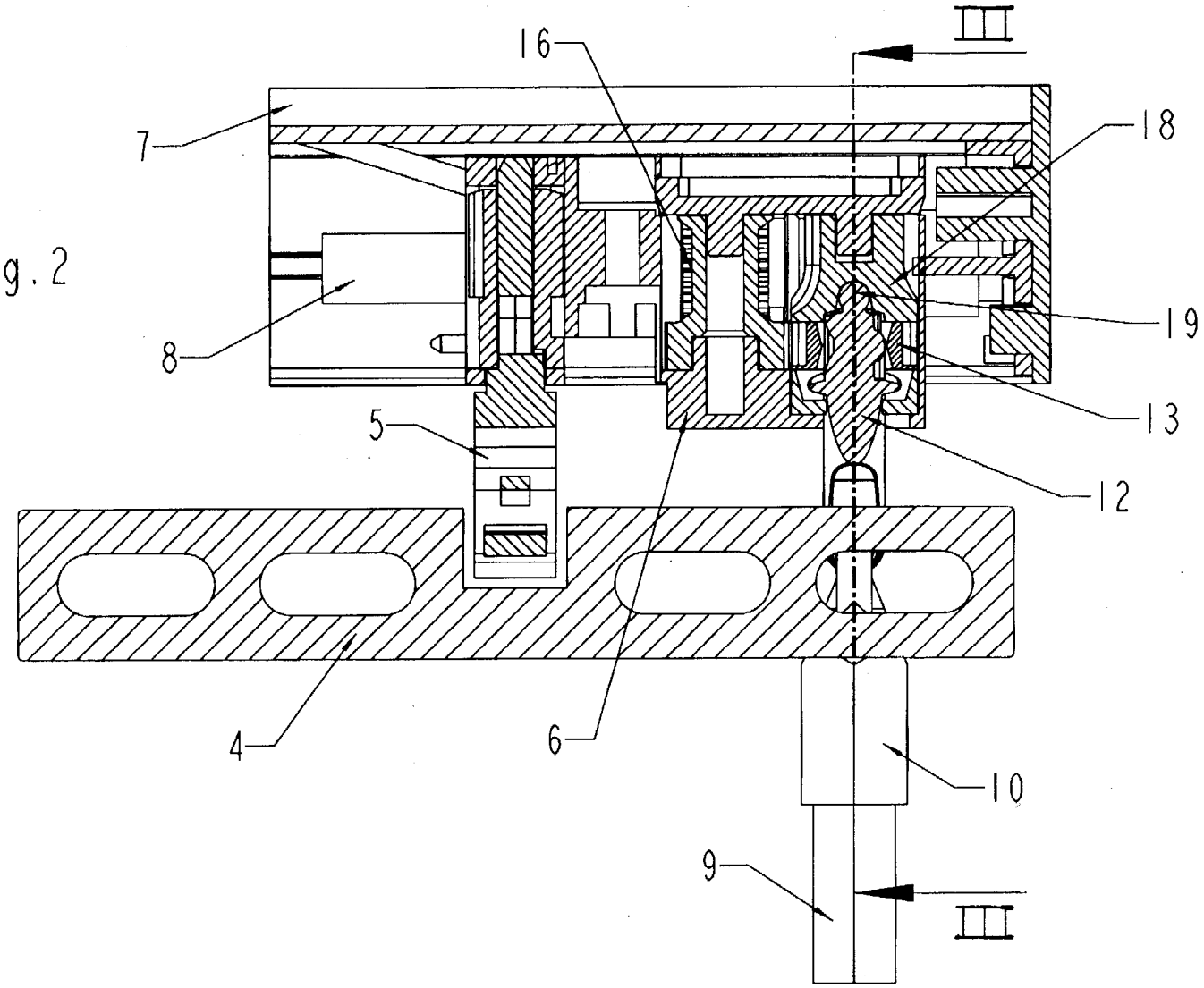
FIG. 2 is a longitudinal sectional view through the pivot drive of a first exemplary embodiment.
Figure 3:
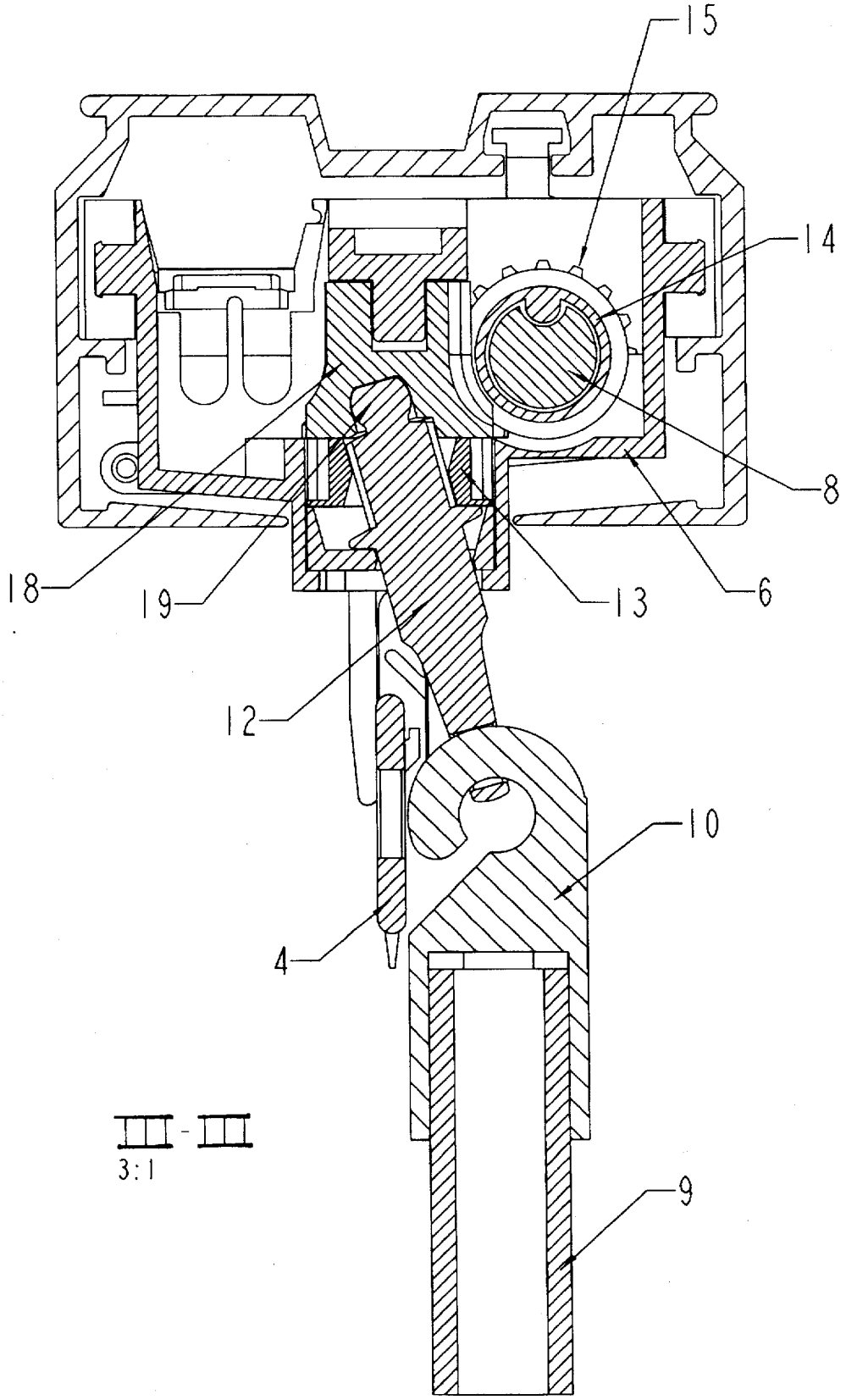
FIG. 3 is a cross sectional view of the arrangement in FIG. 2 approximately according to the line III—III.
Figure 4:
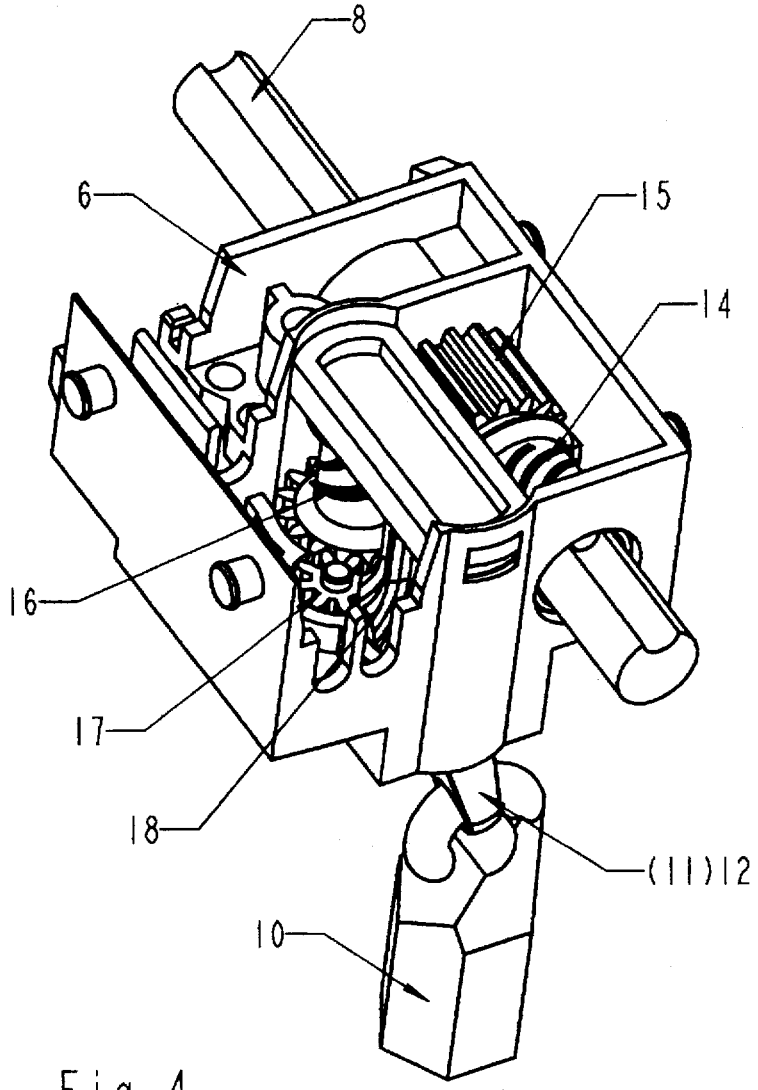
FIG. 4 is a perspective view of a pivot drive according to FIGS. 2 and 3 on an enlarged scale.

In the exemplary embodiment shown in FIGS. 2, 3 and 4, the pivot pin 12 is mounted in a toothed wheel 13 in a manner adapted to rotate in unison, but with its longitudinal axis tiltable against the vertical lines (see FIG. 3). The toothed wheel 13 drives a toothed wheel formed integrally with a worm 16. The toothed wheel 13 either drives the toothed wheel part of worm 16 directly or via an intermediate wheel 17. The worm 16 drives a toothed wheel 15. A worm 14 is connected with the toothed wheel 15 in a manner adapted to rotate in unison. Thus, the toothed wheel 15 and the worm 14 are mounted axially displaceably on the pivot shaft 8. The worm 14 meshes with the toothing of a rotatably mounted element 18, in which the pivot pin 12 with a spherical joint 19 designed on its upper end is mounted eccentrically.

Starting from the closed hanging position shown in FIG. 2, in which the slats 1 and correspondingly also their slat holders 14 are aligned parallel to one another in the closed hanging plane, a rotation of the crank rod 9 via the pivot pin 12 by means of the pivot drive brings about a rotation of the pivot shaft 8 for driving the support pin 5 to pivot slats 1. At the same time a rotation of the element 18 takes place via the toothed wheel 13, the intermediate wheel 17 (optional), the worm 16, the toothed wheel 15, and the worm 14. By means of the eccentric mounting of the spherical joint 19 in the element 18 and the cardanic mounting of the pivot pin 12 in the toothed wheel 13, a tilting movement takes place in one or the other direction corresponding to the view in FIG. 3. That is, the rotation of element 18 causes the eccentrically mounted spherical joint 19 to move.

Figure 5:
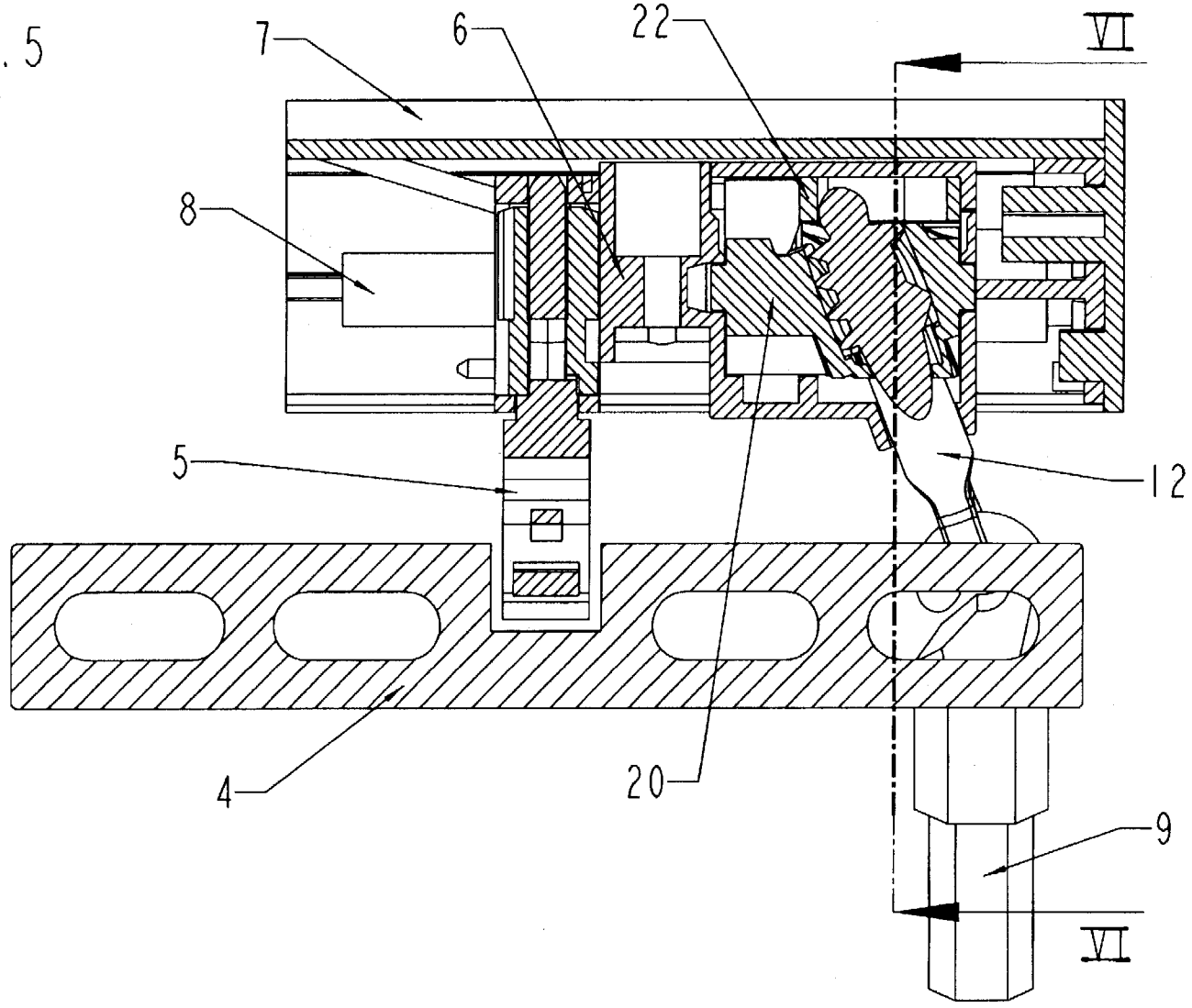
FIG. 5 is a longitudinal sectional view through another exemplary embodiment.
Figure 6:
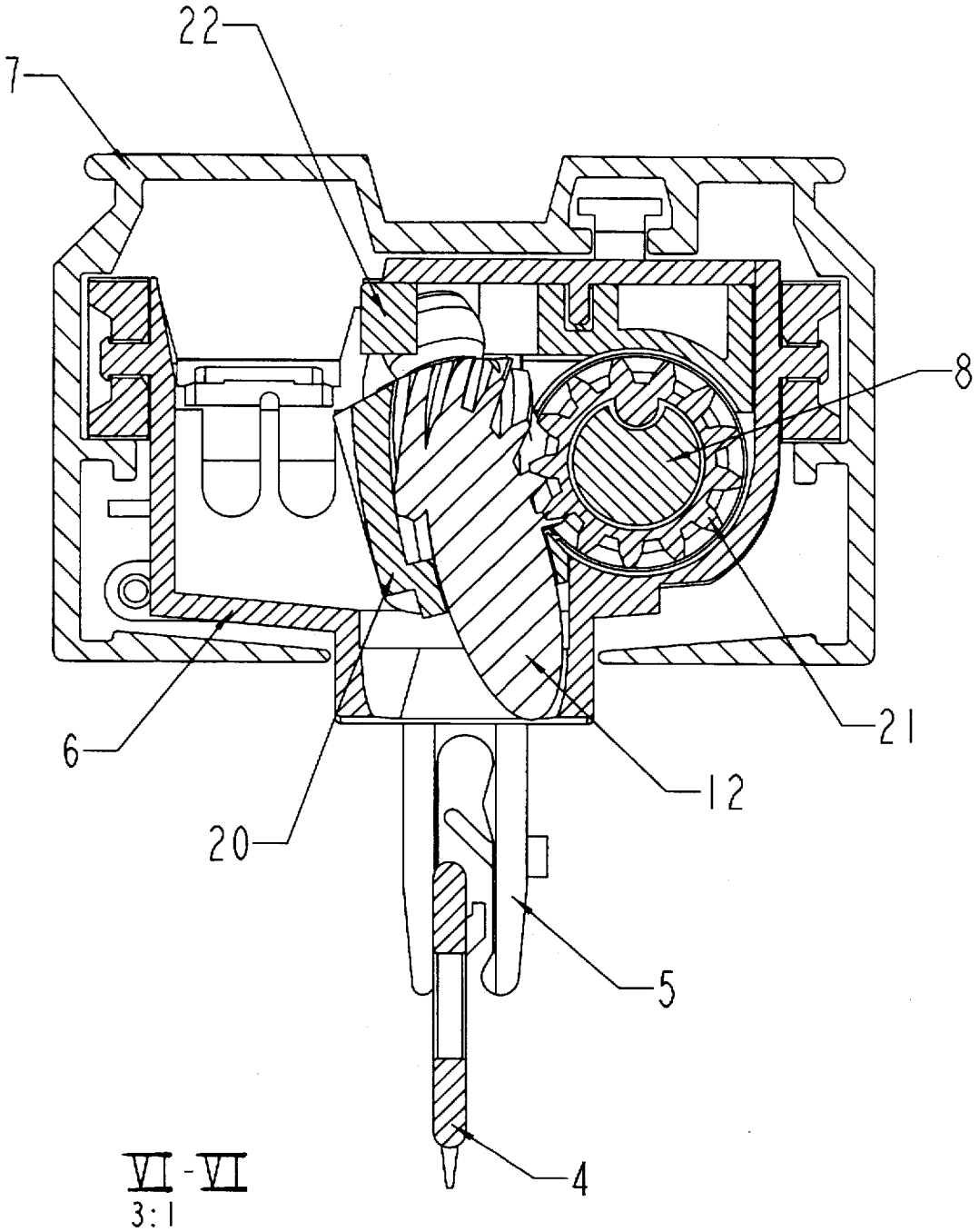
FIG. 6 is a cross sectional view of the arrangement according to FIG. 5 approximately along the line VI—VI.
Figure 7:
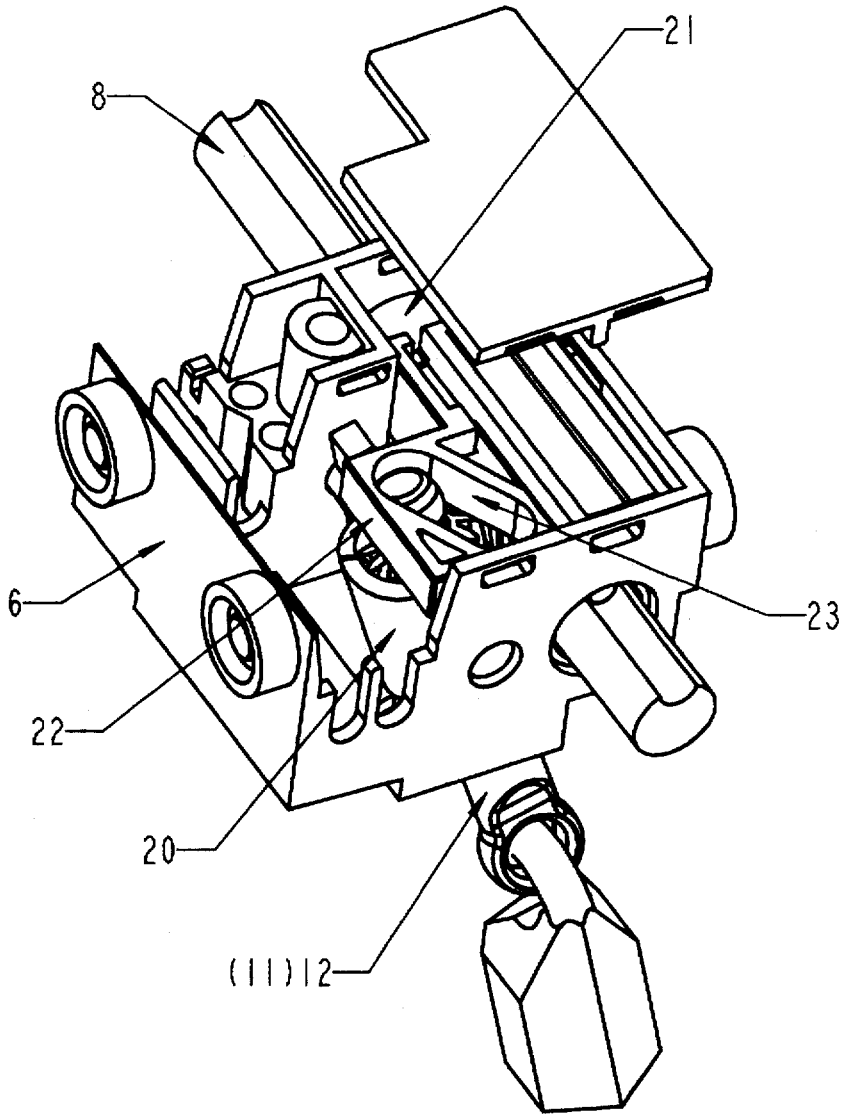
FIG. 7 is a perspective top view of the pivot drive according to FIGS. 5 and 6 on an enlarged scale.

In the exemplary embodiment in FIGS. 5, 6 and 7, the pivot pin with its longitudinal axis sloped against the vertical lines (at an angle with respect to a vertical direction) is rotatably mounted in a mount 20. A worm toothing **12*a* on the circumference of the pivot pin 12 meshes with the toothing 21*a* of a worm wheel 21. The worm wheel 21 is arranged on the pivot shaft 8 in an axially displaceable manner, but in a manner adapted to rotate ill unison with the pivot shaft 8 at the same time. On the body of the worm wheel 21 there is provided a spindle worm 21*b*. The spindle worm 21*b* meshes with a female thread of a slide 22. The slide 22 has a rocker arm 23, directed horizontally diagonally to the closed hanging plane. The rocker arm 23 engages the upper end of the pivot pin 12. With this engagement, the rocker arm 23 guides the pivot pin 12, so that the slide 22, with the rotation of the pivot pin 12, executes a linear movement and changes the pivot pin 12 in its slope position at the same time. Depending on the direction of rotation of the crank rod, the slide moves in one or the other direction and thus tilts the pivot pin 12** with its longitudinal axis. This results in the crank rod moving from one side to the opposite side or back during the pivoting movement of the slat.

While specific embodiments of the invention have been shown and described in detail to illustrate the application of the principles of the invention, it will be understood that the invention may be embodied otherwise without departing from such principles.

What is claimed is:

1. A vertical blind device, comprising:

a crank rod for operation of the device;

a plurality of vertically oriented planar slats jointly pivotable about the vertical axis by 180° from a stopped substantially coplanar closed hanging position, defining a closed hanging plane and substantially parallel to one another, into another stopped substantially coplanar closed hanging position in said closed hanging place;

a housing;

a pivot pin connected to said housing and connected to said crank rod for rotation upon rotation of said crank rod;

pivot drive means connected to said crank rod via said pivot pin and connected to said slats for driving said slats for pivoting said slats about said vertical axis; and pivot shifting means for changing a tilt direction of said pivot pin upon actuation of said drive means.

2. The vertical blind device according to claim 1, wherein:

said pivot drive means includes a pivot shaft and a rotatable worm wheel driven by said pivot pin and driving said pivot shaft in rotation; and said pivot shifting means includes a rotatably mounted element driven by said pivot shaft, said pivot pin being mounted in a cardanically movable manner connected with said rotatably mounted element eccentrically to an axis of rotation of said rotatably mounted element, said rotatably mounted element being driven substantially synchronously with said pivot shaft.

3. The vertical blind device in accordance with claim 2, wherein said rotatably mounted element is toothed, and said pivot pin includes a spherical joint provided on its free end engaging said rotatably mounted element of said pivot drive in said cardanically movable manner.

4. The vertical blind device in accordance with claim 3, wherein said rotatable worm engages a toothed wheel arranged on said pivot shaft in an axially displaceable manner and adapted to rotate in unison with said pivot shaft, said toothed wheel being driven by said rotatable worm wheel, said toothed wheel additionally having worm toothing, said worm toothing meshing with toothing of said rotatably mounted element, said rotatably mounted element having an eccentric joint connection with said pivot pin.

5. The vertical blind device in accordance with claim 1, wherein said slats are hung on slat carriages, which are horizontally movable on a support rail.

6. The vertical blind device in accordance with claim 1, wherein:

said pivot drive means includes a pivot shaft with a worm wheel mounted on said pivot shaft in an axially displaceable manner and adapted to rotate in unison with said pivot shaft;

said pivot pin is mounted in said housing and includes a worm toothing which meshes with toothing of a said worm wheel; and said pivot shifting means includes a spindle worm provided on said pivot shaft and a slide part with a female thread portion, said spindle worm meshing with said female thread portion of said slide part, said pivot pin having an upper end engaging said slide part, said slide part guiding a pivoting movement of said pivot pin.

7. A vertical blind device in accordance with claim 6, wherein said slats are hung on slat carriages, which are horizontally movable in a support rail.

8. A. A vertical blind device, comprising:

a crank rod for operation of the device;

a plurality of vertically oriented planar slats jointly pivotable about their vertical axis by 180° from a stopped substantially coplanar closed hanging position, defining a closed hanging plane and being parallel to one another, into another stopped substantially coplanar closed hanging position in said closed hanging plane;

a housing;

a pivot pin connected to said housing and connected to said crank rod for rotation upon rotation of said crank rod;

pivot drive means connected to said crank rod via said pivot pin and connected to said slats for driving said slats for pivoting about said vertical axis; and pivot shifting means for changing a tilt direction of said pivot pin upon actuation of said drive means, whereby said pivot pin is located in stop positions corresponding to pivot closed positions of said slats, said pivot pin stop positions being laterally outside a closed slat plane and whereby when a direction of rotation of said pivot pin is reversed, said pivot pin moves from one side to the other side of said closed slat plane together with a 180° pivoting movement of said slats.

9. The vertical blind device according to claim 8, wherein:

said pivot drive means includes a pivot shaft and a rotatable worm wheel driven by said pivot pin and driving said pivot shaft in rotation; and said pivot shifting means includes a rotatably mounted element driven by said pivot shaft, said pivot pin being mounted in a cardanically movable manner connected with said rotatably mounted element eccentrically to an axis of rotation of said rotatably mounted element, said rotatably mounted element being driven substantially synchronously with said pivot shaft.

10. The vertical blind device in accordance with claim 9, wherein said rotatably mounted element is toothed, and said pivot pin includes a spherical joint provided on its free end engaging said rotatably mounted element of said pivot drive in said cardanically movable manner.

11. The vertical blind device in accordance with claim 10, wherein said rotatable worm engages a toothed wheel arranged on said pivot shaft in an axially displaceable manner and adapted to rotate in unison with said pivot shaft, said toothed wheel being driven by said rotatable worm wheel, said toothed wheel additionally having worm toothing, which meshes with toothing of said rotatably mounted element, said rotatably mounted element having an eccentric joint connection with said pivot pin.

12. The vertical blind device in accordance with claim 9, wherein said slats are hung on slat carriages, which are horizontally movable on a support rail.

13. The vertical blind device in accordance with claim wherein:

said pivot drive means includes a pivot shaft with a worm wheel mounted on said pivot shaft in an axially displaceable manner and adapted to rotate in unison with said pivot shaft;

said pivot pin is mounted in said housing and includes a worm toothing which meshes with toothing of a said worm wheel; and said pivot shifting means includes a spindle worm provided on said pivot shaft and a slide part with a female thread portion, said spindle worm meshing with said female thread portion of said slide part, said pivot pin having an upper end engaging said slide part, said slide part guiding a pivoting movement of said pivot pin.

14. A vertical blind device in accordance with claim 13, wherein said slats are hung on slat carriages, which are horizontally movable in a support rail.

* * * * *